US007798342B2

(12) United States Patent
Pustinger et al.

(10) Patent No.: US 7,798,342 B2
(45) Date of Patent: Sep. 21, 2010

(54) PRODUCT DISPLAY FOR DISPLAYING PRODUCTS IN AN AISLE AT A RETAIL STORE

(75) Inventors: James Michael Pustinger, Terrace Park, OH (US); Scott Allen Carlson, Centerville, OH (US); Dennis Patrick Feltner, Middletown, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 421 days.

(21) Appl. No.: 11/787,306

(22) Filed: Apr. 16, 2007

(65) Prior Publication Data

US 2008/0251481 A1 Oct. 16, 2008

(51) Int. Cl.
*A47G 29/087* (2006.01)

(52) U.S. Cl. ..... 211/119.003; 248/300

(58) Field of Classification Search ..... 211/49.1, 211/59.1, 64, 65, 68, 70.2, 70.5, 70.8, 75, 211/86.01, 107, 189, 103, 119.003, 190, 211/207; 248/201, 208, 300; 40/642.01, 40/642.02, 657
See application file for complete search history.

(56) References Cited

U.S. PATENT DOCUMENTS

| | | | | | |
|---|---|---|---|---|---|
| 290,371 | A | * | 12/1883 | Udell | 211/65 |
| 337,767 | A | * | 3/1886 | House | 211/65 |
| 350,523 | A | * | 10/1886 | Bodley | 211/65 |
| 434,819 | A | * | 8/1890 | Beckmann | 211/65 |
| 495,789 | A | * | 4/1893 | Denniston | 211/65 |
| 922,008 | A | * | 5/1909 | Marko | 211/65 |
| 1,138,995 | A | * | 5/1915 | Stewart | 211/65 |
| 1,404,893 | A | * | 1/1922 | Robertson et al. | 211/70.2 |
| 1,821,024 | A | * | 9/1931 | Noble | 211/34 |
| 1,991,102 | A | * | 2/1935 | Kernaghan | 211/49.1 |
| 2,200,435 | A | * | 5/1940 | Thrasher | 248/111 |
| 2,212,129 | A | * | 8/1940 | Rust | 221/289 |
| 2,584,219 | A | * | 2/1952 | Murrell | 312/207 |
| 2,661,920 | A | * | 12/1953 | Gochenour | 248/113 |
| 2,681,156 | A | * | 6/1954 | Williams | 211/49.1 |
| 2,715,467 | A | * | 8/1955 | Smith | 211/49.1 |
| 2,723,762 | A | * | 11/1955 | Leiser | 211/65 |
| 2,787,433 | A | * | 4/1957 | Slavsky et al. | 248/231.71 |
| 2,931,513 | A | * | 4/1960 | Cignoli | 211/35 |
| 2,941,769 | A | * | 6/1960 | Alpard | 248/111 |
| 3,007,618 | A | * | 11/1961 | Davis et al. | 224/411 |
| D215,512 | S | * | 10/1969 | Marrelli | D6/469 |
| 3,685,667 | A | * | 8/1972 | Bell | 211/70.5 |
| 3,780,874 | A | * | 12/1973 | Stacy, Sr. | 211/65 |
| D233,120 | S | * | 10/1974 | Dawson | D7/701 |
| 4,286,717 | A | * | 9/1981 | Liesinger | 211/70.6 |

(Continued)

OTHER PUBLICATIONS

Placement Test, USA, Aug. 13, 2006 (3 printouts of photographs).

*Primary Examiner*—Michael Safavi
*Assistant Examiner*—Joshua Rodden
(74) *Attorney, Agent, or Firm*—David V. Upite; John M. Howell; Larry L. Huston

(57) ABSTRACT

Product displays usable to organize products shelved in aisles at a retail store. The product displays each having shelves and a shelf mounting device. The shelf mounting device having a flexible member extending in a direction perpendicular to the lateral direction of the product display for flexibly supporting a vertical channel holding a product for display.

17 Claims, 2 Drawing Sheets

U.S. PATENT DOCUMENTS 4,305,512 A * 12/1981 Mackenzie ..... 211/75
4,379,432 A * 4/1983 Grossman ..... 108/159
4,541,598 A 9/1985 Villanueva et al.
4,616,799 A * 10/1986 Rebentisch ..... 248/289.31
4,621,737 A * 11/1986 Casey ..... 211/70.5
4,718,627 A 1/1988 Fast et al.
4,805,331 A * 2/1989 Boggess et al. ..... 40/651
4,836,494 A * 6/1989 Johnsen ..... 248/669
4,848,856 A * 7/1989 Dyment et al. ..... 312/135
4,854,556 A 8/1989 Pietrzak
4,871,099 A * 10/1989 Bogar, Jr. ..... 224/566
4,881,707 A * 11/1989 Garfinkle ..... 248/222.12
4,909,464 A * 3/1990 Levine et al. ..... 248/220.22
4,957,256 A * 9/1990 Boeding ..... 248/225.11
5,233,773 A 8/1993 Reynolds
5,237,767 A 8/1993 Kringel et al.
5,238,109 A * 8/1993 Smith ..... 206/315.2
5,277,146 A * 1/1994 Hughes, Jr. ..... 116/63 R
5,289,652 A 3/1994 Kringel et al.
5,305,898 A * 4/1994 Merl ..... 211/87.01
5,325,974 A * 7/1994 Staehs ..... 211/60.1
5,328,137 A 7/1994 Miller et al.
5,573,122 A * 11/1996 Williams ..... 211/70.2
5,617,661 A 4/1997 Mason
5,636,462 A 6/1997 Kleiman
D382,748 S * 8/1997 Riskey ..... D6/516
5,657,884 A * 8/1997 Zilincar, III ..... 211/86.01
5,666,751 A 9/1997 Garfinkle
5,715,952 A * 2/1998 Chichetti ..... 211/70.8
5,722,623 A * 3/1998 Gibson ..... 248/201
5,832,644 A * 11/1998 Mason ..... 40/642.02
5,915,856 A * 6/1999 Yeranossian ..... 40/607.14
5,933,992 A * 8/1999 Padiak et al. ..... 40/606.15
5,960,508 A 10/1999 Holt et al.
6,003,191 A 12/1999 Sherry et al.
RE36,669 E * 4/2000 Zilincar, III ..... 211/86.01
6,048,123 A 4/2000 Holt et al.
6,101,661 A 8/2000 Policicchio et al.
6,109,599 A 8/2000 Kringel
6,202,334 B1 * 3/2001 Reynolds et al. ..... 40/642.02
6,247,258 B1 6/2001 O'Malley
6,279,761 B1 * 8/2001 Niewiadomski et al. . 211/94.01
6,289,618 B1 * 9/2001 Kump et al. ..... 40/657
6,305,046 B1 10/2001 Kingry et al.
6,354,546 B1 * 3/2002 Mueller ..... 248/220.42
D456,268 S 4/2002 Hague et al.
6,363,643 B1 * 4/2002 Padiak et al. ..... 40/606.14
6,386,392 B1 5/2002 Argentieri et al.
6,434,871 B2 * 8/2002 Conway ..... 40/651
6,484,346 B2 11/2002 Kingry et al.
6,533,134 B1 * 3/2003 Menaged et al. ..... 211/87.01
6,581,312 B2 * 6/2003 Padiak et al. ..... 40/606.15
6,637,595 B1 * 10/2003 Frossard et al. ..... 206/443
6,651,290 B2 11/2003 Kingry et al.
6,675,978 B2 * 1/2004 Shea ..... 211/59.1
6,698,124 B2 * 3/2004 Kump et al. ..... 40/642.02
D489,537 S 5/2004 Wong et al.
6,797,357 B2 9/2004 Fereshtehkhou et al.
6,808,151 B1 * 10/2004 McLaughlin et al. ..... 248/354.1
6,813,801 B2 11/2004 Tanaka et al.
D499,887 S 12/2004 Wong et al.
6,829,854 B2 * 12/2004 Reynolds ..... 40/642.02
6,905,034 B2 * 6/2005 Jones ..... 211/85.18
6,936,330 B2 8/2005 Fereshtehkhou et al.
7,284,740 B2 * 10/2007 Padiak et al. ..... 248/458
7,360,661 B2 * 4/2008 Nickerson ..... 211/94.01
7,467,772 B2 * 12/2008 Scholen et al. ..... 248/289.31
7,549,194 B2 * 6/2009 Vosbikian et al. ..... 16/422
2003/0164346 A1 * 9/2003 Shea ..... 211/59.1
2007/0193965 A1 * 8/2007 Cialdella et al. ..... 211/70.2

* cited by examiner

PRODUCT DISPLAY FOR DISPLAYING PRODUCTS IN AN AISLE AT A RETAIL STORE

FIELD OF THE INVENTION

The present invention is directed to articles and methods for organizing an aisle in a retail store.

BACKGROUND

Store aisles, given the myriad of products that are available, often get cluttered and difficult to sift through, by a shopper. Studies have shown that shoppers, who cannot find a product, will often forgo the item thereby costing the retail store an incremental sale. There is a continuing need to help organize store shelves for the convenience of the shopper and for the economic benefit of the retail store. There is also an opportunity to educate shoppers about new products or products that they have not purchased.

See e.g., U.S. Pat. Nos.: 4,541,598; 4,718,627; 4,854,556; 5,237,767; 5,289,652; 5,328,137; 5,636,462; 5,666,751; 6,109,599; and 6,247,258.

SUMMARY OF THE INVENTION

The present invention attempts to address this need, preferably in the cleaning aisle of the retail store, by providing, in a first aspect of the invention, a product display comprising: (a) a display support fixture comprising a product; and (b) a shelf mounting device capable of vertically mounting the display from a shelf.

A second aspect of the invention provides for a method of organizing products on shelves in a retail store comprising the step of vertically mounting a first product display from a shelf at a retail store, wherein the first display comprises a display support fixture comprising a product; and a shelf mounting device mounting the display from the shelf.

DETAILED DESCRIPTION OF THE INVENTION

Figure 1:
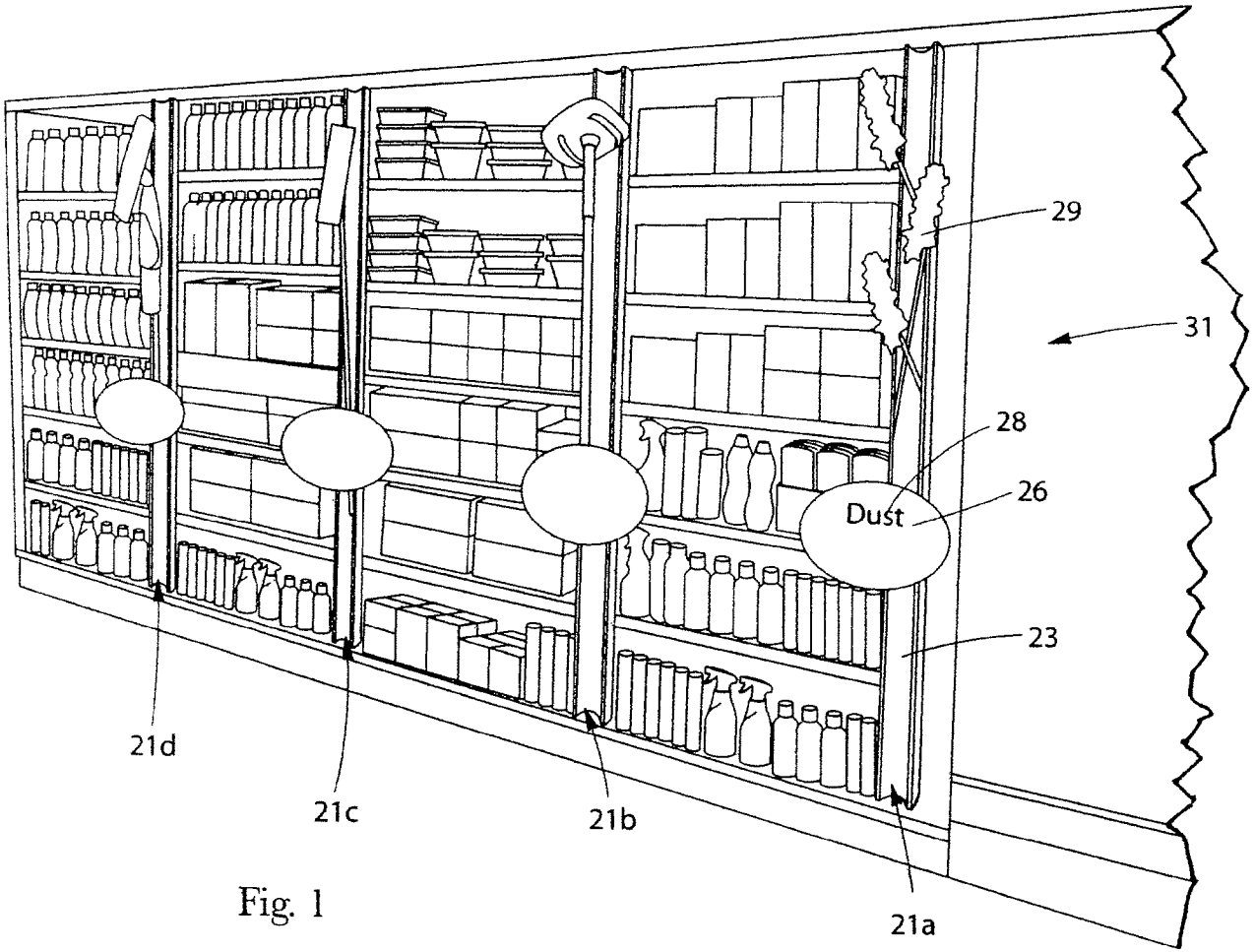
FIG. 1 is a plurality of product displays organizing a cleaning aisle of a retail store.

Definitions:

"Shelf mounting device" is a device capable of mounting the product display to a shelf. The mounting is such that the product display extends into the aisle, away from the shelf or shelving, as if toward the shopper standing in the aisle. Of course the product display should not extend too far in the aisle to inhibit shopper traffic flow but yet should extend far enough to allow shopper access to products on the shelf that are behind or near the product display. There are many shelf mounting devices described in the art. Non-limiting examples of shelf mounting devices may include those described in U.S Pat. Nos.: 4,541,598; 4,718,627; 5,289,652; 5,237,767 and 5,328,137. In one embodiment, the shelf mounting device is flexible, as to allow the product display to withstand contact by shopping carts, shoppers, children and the like that brush by and make contact with the display. The flexibility of the shelf mounting device is one that is elastic, i.e., the product display returns to its original position after contact. Without wishing to be bound by theory, the flexibility of the shelf mounting device mitigates damage or harm to the shopper or cart, as well as the product display, in the event of contact, and may also enable retail products to be stocked and shopped from behind the display. Non-limiting examples of flexible shelf mounting devices may include those described in U.S. Pat. Nos.: 4,854,556 and 6,109,599. In one embodiment, the mounting device comprises a flexible member, wherein the flexible member comprises an elastomeric material (e.g., rubber, polyurethane, etc.) to provide inter alia a point flexion. The rubber, of the flexible member, may be synthetic or non-synthetic or a combination thereof. Without wishing to be bound by theory, a shelf mounting device that comprises an elastomeric material may be less expensive from a material and/or installation cost than those devices having over a spring or coil or other type of mechanical mechanism for the elastic effect. In yet another embodiment, the shelf mounting device (alternatively the product display as a whole) is free or substantially free of a spring or coil or other such device. In yet another embodiment, the product display comprises two (alternatively at least three, four, or more) shelf mounting devices, wherein each shelf mounting device attaches at a different horizontal shelf. Two or more shelf mounting devices may assist in keeping the product display from swaying or to better withstand incidental impact from shoppers (verses a single shelf mounting device). In yet still another embodiment, the product display may comprise one, two, or more products on the same product display. In yet still another embodiment, two or more product displays may be located along the same vertical axis (for example, to showcase two different variations of the same product). In yet still another embodiment, at least two products, each from a different or from the same product category, are showcased on a single product display.

"Vertically mounting" means attaching the product display of the present invention from a shelf or shelves such that the product and/or display support fixture of the product display is displayed vertically relative to the floor (i.e., perpendicular to the floor), wherein the means of attaching is not one where a shopper can easily remove the product from the product display or the product display from the shelf or shelves. The term "vertically," as used herein, means the product/display support fixture/product display is less than 30 degrees in any direction (e.g., x, y, or z planes) from an axis that is perpendicular to the floor. Alternatively, the angle is less than 25°, 20°, 15°, 10°, 5°, 3°, or 1° from an axis that is perpendicular to the floor. The product display is capable of being permanently or semi-permanently attached from the shelf (e.g., use of bolts and nuts, rivets, ties, and other fasteners). In one embodiment, the product on the product display is substantially "eye-level" to a typical consumer to facilitate easy viewing and inspection of the product.

For purposes of clarification, the product is considered "vertical" relative to the majority of the handle or pole. In other words, if the product is a sweeper with a disposable sheet (such as SWIFFER sweeper), the receiver for a disposable substrate (i.e., the part where the disposable sheet attaches to the implement), may be angled or tilted and yet one skilled in the art would still characterize the product as "vertically mounted" consistent as how applicants have defined the term herein.

"Shelf" is a shelf that is typically used in a retail store to support or display products for sale at the store. A non-limiting example many include the shelves in an aisle at a grocery store. It is appreciated that a shelf may or may not be horizontal, relative to the floor.

"Display support fixture" serves the function(s) of showcasing the product and/or providing a vertical visual line of demarcation on the shelves of the aisle thereby indicating to the shopper that the product display represents a boundary between product types or product categories of one variety verses those of another variety. Furthermore, the product that is being showcased by the product display may assist in indicating to the shopper the identity of the product type or product categories that may be localized adjacent to the product display. For example, if the product is a SWIFFER DUSTER, then those products that are useful or assist in dusting may be localized together on the shelves at or near the product display. The display support fixture may comprise, in one embodiment, a channel and/or intermediary support member. The showcased product may be apart from its typical packaging. The product may also be assembled to better communicate to the shopper how the product looks after the product is assembled.

"Channel" may be curved (convex or concave relative to the shopper in the aisle) or may be flat. The channel, in one embodiment, has a vertical length of from about 2 feet to about 10 feet, alternatively from about 3 feet to about 9 feet, from about 4 feet to about 8 feet, from about 5 feet to about 7 feet, from about 3 feet to about 6 feet, from about 6 feet to about 8 feet, or combinations thereof.

When curved, the channel may comprise a cross section (taken horizontally when the channel is vertical, i.e., perpendicular to the floor) providing a curve of about 0.25 radians to about 2 radian, alternatively from about 0.5 radian to about 1.5 radian, from 0.75 to a about 1.25 radian, or combinations thereof. The width of the channel, in one embodiment, is from about 0.5 inches to about 2 feet, with the appreciation that the "width" is the greatest cross sectional dimension of the channel, and such measurement taken horizontally (i.e., parallel with the shelf) when the channel is aligned vertically relevant to the shelves (i.e., perpendicular to the floor). Alternative widths of the channel may include from about 1 inch to about 15 inches, alternatively from about 3 inches to about 12 inches, from about 5 inches to about 10 inches, from about 7 inches to about 9 inches, from about 3 inches to about 8 inches, from about 6 inches to about 9 inches, and combinations thereof.

In one embodiment, when the aisle comprises more than one product display of the present invention, wherein one channel may comprise a different color than a second channel, and wherein the color of the second channel is different from the color of a third channel, and so on. Different colors on each respective channel may assist in the organization of the aisle by indicating that different product types or product categories are localized at or near the different channels (or product displays). The channels, and the colors thereof, may help to act as lines of demarcation to help visually indicate the separate areas of the aisle to the shopper.

"Intermediary support member" services the function of joining one or more shelf mounting devices to the channel. Examples of an intermediary support member may be a rod, pole, pipe, rectangular metal rod, or the like. The length of an intermediary support member, in one embodiment, is greater than the length of the channel, alternatively about the same length, or slightly less than, or less than the length as the channel (e.g., from about 3 feet to about 6 feet, alternatively 4 feet to about 6 feet, from about 5 feet to about 6 feet, alternatively about 4 to about 5 feet, alternatively about 4.5 feet to about 5.5 feet).

"Signage" means a sign that assists in communicating the area of the aisle and/or the function of the product of the product display (of the present invention), and/or communicate to the shopper how products on the shelf or shelves are organized. For example, an aisle may contain 1, 2, 3, 4, or more product displays of the present invention each with unique signage that may communicate "mop" "sweep," "carpet," "dust" by the use of words, graphics, pictures, symbols, and the like, or combinations thereof. Of course different languages, verb tenses, and variations on the word can be used (e.g., mopping). In one embodiment, the signage is mounted below the vertical midpoint of the shelves and/or tilted at an angle upwards (e.g., 5-30, alternatively 10-20 degrees from a vertical plane) to the shopper to facilitate easy viewing of the signage by shopper when the shopper is standing in front of the shelves in question deciding which product on the shelf to purchase. Non-limiting examples of signage may include those described in U.S. Pat. Nos.: 5,636,462; 5,666,751; and 6,247,258. The product of the product display may compliment the signage (and vice versa). For example, the signage may use the word "mop" and the product may be a "mop" or a SWIFFER Wet Jet Sweeper, or the like.

In one embodiment, the shelves comprise a banner or footer messaging to also communicate to the shopper. The signage may compliment the banner or footer by including the same color or re-enforcing a message or text or the like.

"Product" is any product suitable for sale at a retail store. In one embodiment, the product is one suitable for cleaning, such as a cleaning implement. In one embodiment, the cleaning (alternatively household cleaning) implement comprises a handle, pole, disposable substrate, receiver for a disposable substrate, or combination thereof. In one embodiment, the household cleaning implement is suitable for cleaning floors, carpets, toilets, and combinations thereof. In another embodiment, the household cleaning implement is suitable for dusting. In yet another embodiment, the product comprises a disposable substrate. In such an embodiment, the product may or may not be showcased with its corresponding disposable substrate (e.g., non-woven substrate). The product may or may not be showcased with any liquid cleaners that the product is designed to be used with (such as SWIFFER Wet Jet Sweeper). Non-limiting examples of products include mops, brooms, SWIFFER Sweeper, SWIFFER Wet Jet Sweeper, SWIFFER Dry Sweeper, SWIFFER Duster, SWIFFER Carpet Flick, and the like. Examples of such products, cleaning implements, and disposable substrates may include those described in U.S. Pat. Nos.: 6,305,046; 6,484,346; 6,651,290; 6,797,357; 6,936,330, D489,537, and D499,887. See also U.S. Pat. Nos.: D456,268 and 5,960,508; 6,003,191; 6,048,123; 6,101,661; 6,386,392. See yet also U.S. Pat. No. 6,813,801. Other products may include 3M's SCOTHBRITE Carpet Touch-Up Roller (that comprises an adhesive substrate); and CHURCH & DWIGHT's ORANGE GLO Hardwood Floor Care System with a hook and loop system for adhering the mop or pad substrate to the implement. Yet other products may include oversized mock-ups of shaving razors, toothbrushes, and the like. Exemplary product forms and brands are described on The Procter & Gamble Company's website, www.pg.com, and the linked sites found thereon.

"Retail store" or "store" means a store suitable for selling products. Examples of a retail stores include WAL-MART, COSTCO, TARGET, KROGER, TESTCO, HOME DEPOT, LOWES, CARREFOUR and the like.

Figure 2:
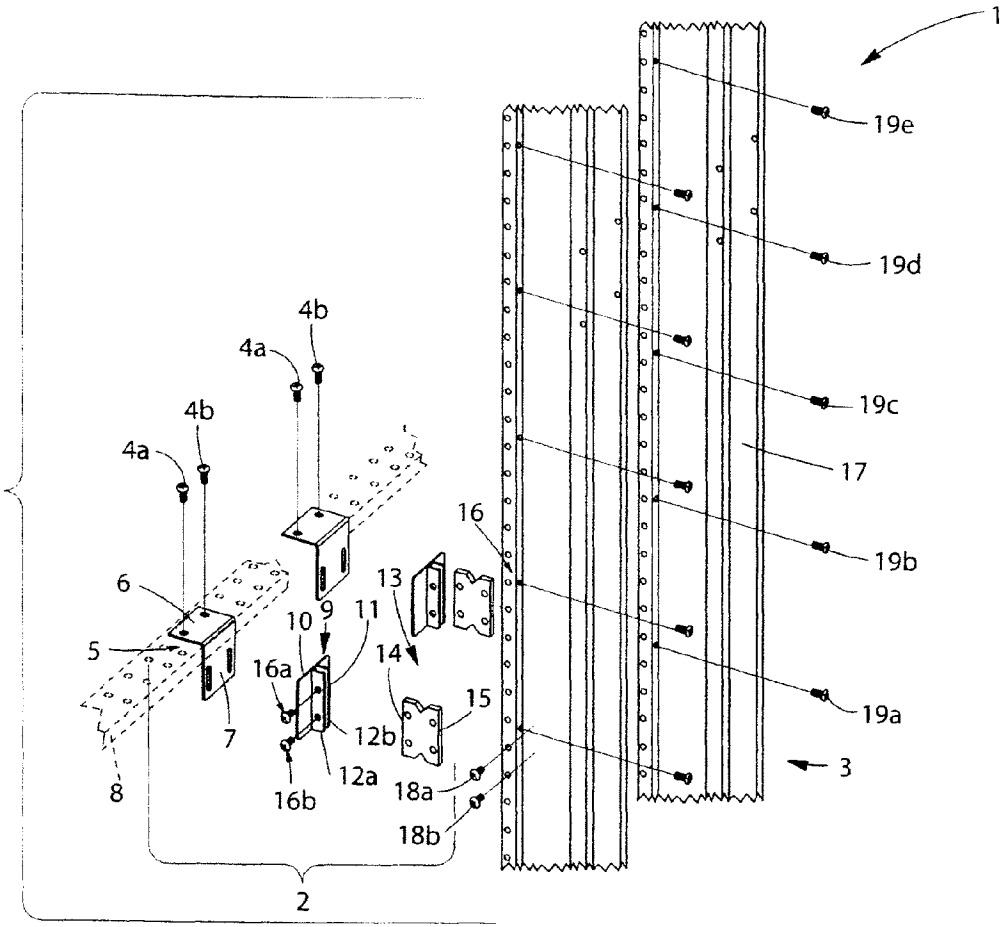
FIG. 2 is a shelf mounting device and display support fixture of a product display.

FIGS. 1 and 2: Turning to FIG. 1, the product displays 21*a*, 21*b*, 21*c*, and 21*d*, of the present invention provide the function, in part, of organizing an aisle 31 for household cleaners and household cleaning implements (not shown). In a first product display 21*a*, the product 29 is a dusting implement that is mounted in front of (relative to a shopper who would be standing in the aisle) the channel 23. The signage 26 of the first product display 21*a* compliments the dusting implement by illustrating the word "Dust" 28. Products useful for dusting are located near the first product display 21*a* (not shown) for easy identification by the shopper.

Turning to FIG. 2, an example of a shelf mounting device 2 and display support fixture 3 of a product display 1 is described. In turn, the shelf mounting device 2 comprises an L-shaped angled bracket 5, a U-shaped flange 9, and a flexible member 13. The display support fixture 3 comprises a U-shaped intermediary support member 16 and a curved channel 17.

The mounting device 2 of FIG. 2 comprises an L-shaped angled bracket 5. A first side 6 of the L-shaped angled bracket 5 is mounted with a first set of bolts 4*a*, 4*b* to the product shelf 8. A second side 7 of the L-shaped angled bracket 5 is used to fasten the first side 10 of a U-shaped flange 9. The first side 10 of the U-shaped flange 9 has two welded stud bolt (not shown) that join the U-shaped flange 9 to the L-shaped angled bracket 5. The second side 11 of the U-shaped flange 9 contains two ridges 12*a*, 12*b* protruding out at 90 degree angle (i.e., perpendicular) from the second side 11 of the U-shaped flange 9 to receive the flexible member 13. The flexible member is made of an elastomeric material (e.g., rubber) which is about ⅜ inches in thickness, about 2 inches in width, and about 3 inches in length. In turn, a first edge 14 of the flexible member 13 inserts between the ridges 12*a*, 12*b* of the U-shaped flange 9. A second set of bolts 16*a*, 16*b* traverse through and join the ridges 12, 12*b* with the first edge 14 the flexible member 13. The second edge 15 of the flexible member 13 connects the support display fixture 3. In turn, the display support fixture 3 comprises a U-shaped intermediary support member 16 and a curved channel 17. The U-shaped intermediate support member 16 has a cavity (not shown) to receive the second edge 15 of the flexible member 13. A third set of bolts 18*a*, 18*b* are used to join the flexible member 13 to the U-shaped intermediary support member 16. A fourth set of bolts 19*a*, 19*b*, 19*c*, 19*d*, 19*e*, are used to connect the U-shaped intermediary support member 16 and channel 17 together. Although not shown, bolts or any other means may be used to connect product to the curved channel 17.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the DETAILED DESCRIPTION OF THE INVENTION are, in the relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A product display comprising:

(a) shelves;

(b) a shelf mounting device comprising:

(i) a bracket affixed to one of said shelves (ii) a flange affixed to the bracket, wherein the flange has a vertical slot that vertically and perpendicular to the lateral direction of the product display and receives a flexible member therein;

(iii) the flexible member being affixed vertically within the slotted flange and extending therefrom in a direction perpendicular to the lateral direction of the product display;

(iv) an intermediary support member affixed to the portion of the flexible member extending from the slotted flange;

(v) at least one vertical channel affixed to the intermediary support member and capable of lateral deflection along its vertical axis; and (vi) a consumer product affixed to and parallel with said at least one vertical channel.

2. The display of claim 1, wherein the shelf mounting device's flexible member comprises elastomeric materials.

3. The display of claim 1, wherein the vertical channel's length transverse to its cross section is at least two feet.

4. The display of claim 1, wherein the vertical channel has an arcuate cross section with the terminus of the arch directionally perpendicular to the lateral direction of the product display.

5. The display of claim 2, wherein the elastomeric material is free of coils and springs.

6. The display of claim 5 wherein the consumer product's length approximates the vertical channel's length.

7. The consumer product of claim 6, wherein the consumer product is a cleaning implement.

8. A product display comprising:

(a) shelves;

(b) a plurality of shelf mounting devices, each shelf mounting device comprising:

(i) a bracket affixed to one of said shelves;

(ii) a flange having a vertical slot, wherein the flange is affixed to the bracket and extends perpendicular to the lateral direction of the product display;

(iii) a flexible member, a portion of which is affixed vertically within the vertical slot and extends from said flange perpendicular to the lateral direction of the product display ;

(iv) an intermediary support member affixed to the extended portion of the flexible member;

(v) a vertical channel affixed to the intermediary support member and capable of lateral deflection along its vertical axis; and (vi)) a consumer product affixed to and parallel with the vertical channel.

9. The display of claim 8 wherein the shelf mounting devices' flexible members comprise elastomeric materials.

10. The display of claim 8 wherein the vertical channels' lengths transverse to its cross section is at least two feet.

11. The display of claim 8 wherein the vertical channels comprise those having arcuate cross sections with each arch having terminus points facing directionally perpendicular to the lateral direction of the product display.

12. The display of claim 9 wherein the elastomeric materials are free of coils and springs.

13. The product display of claim 9 wherein each vertical channel has affixed parallel with the vertical channels a different consumer product.

14. The consumer product of claim 13 wherein the consumer products are cleaning implements.

15. The cleaning implement of claim 14 wherein the cleaning implements are approximately equal length with the vertical channel.

16. The product display of claim 15 wherein the cleaning implements are a variety and different from one another.

17. The consumer product of claim 16 wherein the cleaning implements are floor cleaning implements.

* * * * *